US005771794A

United States Patent [19]

Benizri et al.

[11] Patent Number: 5,771,794

[45] Date of Patent: Jun. 30, 1998

[54] PAPER DISPOSAL AND COMPACTING SYSTEM

[75] Inventors: Ilan Benizri, Herzlia; Shimshon Ahimeir, Raanana, both of Israel

[73] Assignee: Scitex Corporation Ltd., Herzlia, Israel

[21] Appl. No.: 706,056

[22] Filed: Aug. 30, 1996

[30] Foreign Application Priority Data

Sep. 5, 1995 [IL] Israel ..... 115172

[51] Int. Cl.[6] ..... B30B 9/00; B30B 3/04

[52] U.S. Cl. ..... 100/80; 100/171; 100/172; 100/173; 100/176

[58] Field of Search ..... 100/76–81, 155 R, 100/171–173, 176

[56] References Cited

U.S. PATENT DOCUMENTS

| | | | |
|---|---|---|---|
| 942,443 | 12/1909 | Gallaread | 100/80 |
| 1,090,914 | 3/1914 | Guettler | 100/176 |
| 1,456,265 | 5/1923 | Brooks | 100/171 |
| 3,601,038 | 8/1971 | Hayes | 100/171 |
| 4,286,515 | 9/1981 | Baumann et al. | 100/172 |
| 4,768,432 | 9/1988 | Storlie . | |

FOREIGN PATENT DOCUMENTS

| | | | |
|---|---|---|---|
| 0378276 | 7/1990 | European Pat. Off. | 100/76 |
| 61-162300 | 7/1986 | Japan | 100/155 R |

*Primary Examiner*—Stephen F. Gerrity
*Attorney, Agent, or Firm*—Mark M. Friedman

[57] ABSTRACT

A paper disposal and compacting apparatus capable of causing sheets of paper and other substrates to be disposed, to fold in a compact accordion like manner. The apparatus includes a first roller and a second roller adjacent and parallel to one another to force the sheets to pass between the rollers and a first roller driving device for rotating the first roller. The apparatus further includes a paper waste container for receiving the sheets after passing between the rollers. The container dimensions sized to match the sheets to be disposed to cause the folding in the compact accordion like manner of the sheets.

27 Claims, 8 Drawing Sheets

USERS 5 PLOTER/

PAPER DISPOSAL AND COMPACTING SYSTEM

FIELD AND BACKGROUND OF THE INVENTION

The present invention relates to a paper disposal and compacting apparatus capable of causing sheets of paper and, other substrates to be disposed, to fold in a compact accordion like manner.

Many business entities generate vast amounts of paper waste which is to be disposed. These include, for example, documents containing classified information and other types of paper work produced by offices and, sheets of paper employed for protective and/or separative packaging of protection demanding merchandises. An example of the later is the inter-plate paper used for protective packaging and separation of aluminum plates, which plates are used, for example, by C.T.P (computer-to-plate technology) plotters, for the aluminum plates exposure by a laser beam.

Many devices were developed to safely dispose documents containing classified information and are generally referred to as paper shredders. Paper shredders generally perform a dual function of document destruction and compacting. Such a device is disclosed, for example, in U.S. Pat. No. 4,768,432. This device is a paper shredding and compacting machine for destroying documents and simultaneously compressing the generated waste into a disposable cylinder. Nevertheless, paper shredders are often noisy when operated and tend to stuck if a thick bundle of paper sheets or a thick paper sheet is to be shredded.

However, when paper sheets employed for protective and/or separative packaging or, unclassified documents and the like are to be disposed, shredding becomes unnecessary and redundant.

The paper disposal and compacting apparatus of the present invention is efficiently capable of compacting sheets of paper to be disposed into a compact and compressed package. Furthermore, the paper disposal and compacting apparatus of the present invention is capable of disposing thick paper bundles and thick sheets of paper and, since no shredding is involved in its operation, the paper disposal and compacting apparatus of the present invention operates substantially noise-free.

There is thus a widely recognized need for, and it would be highly advantageous to have, a paper disposal and compacting apparatus which is efficiently capable of compacting sheets of paper to be disposed into a compact and compressed package.

SUMMARY OF THE INVENTION

According to the present invention there is provided a paper disposal and compacting apparatus capable of causing sheets of paper and other substrates to be disposed, to fold in a compact accordion like manner.

According to further features in preferred embodiments of the invention described below, the paper disposal and compacting apparatus, including (a) a first roller and a second roller adjacent and parallel to one another to force the sheets to pass between the rollers; (b) a first roller driving device for rotating the first roller; (c) a paper waste container for receiving the sheets after passing between the rollers. The container dimensions matching to the size of the sheets to be disposed and, therefore, cause the sheets to fold in the compact accordion like manner.

According to still further features in the described preferred embodiments the first roller driving device is further connected to the second roller to rotate it.

According to still further features in the described preferred embodiments the paper disposal and compacting apparatus further including a relay mechanism, the relay mechanism connecting the second roller to the first roller for rotating the second roller;

According to still further features in the described preferred embodiments the relay mechanism is a gear relay mechanism.

According to still further features in the described preferred embodiments the relay mechanism is a band based relay mechanism.

According to still further features in the described preferred embodiments the paper disposal and compacting apparatus further including a second roller driving device to rotate the second roller.

According to still further features in the described preferred embodiments the paper disposal and compacting apparatus further including first and second paper guidings directing the sheets of paper to be disposed between the first and second rollers.

According to still further features in the described preferred embodiments at least one of the first and second rollers has alternating ridges and grooves along at least part of its length.

According to still further features in the described preferred embodiments at least one of the first and second rollers is made of a material which is selected from the group of materials consisting of rubber, metal, plastic, wood, glass, synthetic polymers, natural polymers and any combinations of rubber, metal, plastic, wood, glass, synthetic polymers and natural polymers.

According to still further features in the described preferred embodiments the rollers are laterally movable one relative to the other in relation to the paper sheets thickness.

According to still further features in the described preferred embodiments the dimensions of the paper waste container are adjustable in relation to the size of the paper sheets.

According to still further features in the described preferred embodiments the apparatus further including a bias mechanism to press the rollers against the paper sheets.

The present invention successfully addresses the shortcomings of the presently known configurations by providing a simple paper disposal and compacting apparatus which is efficiently capable of causing sheets of paper and, other substrates to be disposed, to fold in a compact accordion like manner.

The present invention discloses a novel paper disposal and compacting apparatus which is efficiently capable of folding sheets of paper to be disposed into a compact and compressed package, in a noise-free fashion.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a paper disposal and compacting apparatus capable of causing sheets of paper and other substrates to be disposed, to fold in a compact accordion like manner. Specifically, the present invention can be used to efficiently dispose documents and other types of paper work produced by offices and sheets of paper employed for protective and/or separative packaging of protection demanding merchandises.

The principles and operation of a paper disposal and compacting apparatus according to the present invention may be better understood with reference to the drawings and the accompanying description.

Figure 1:
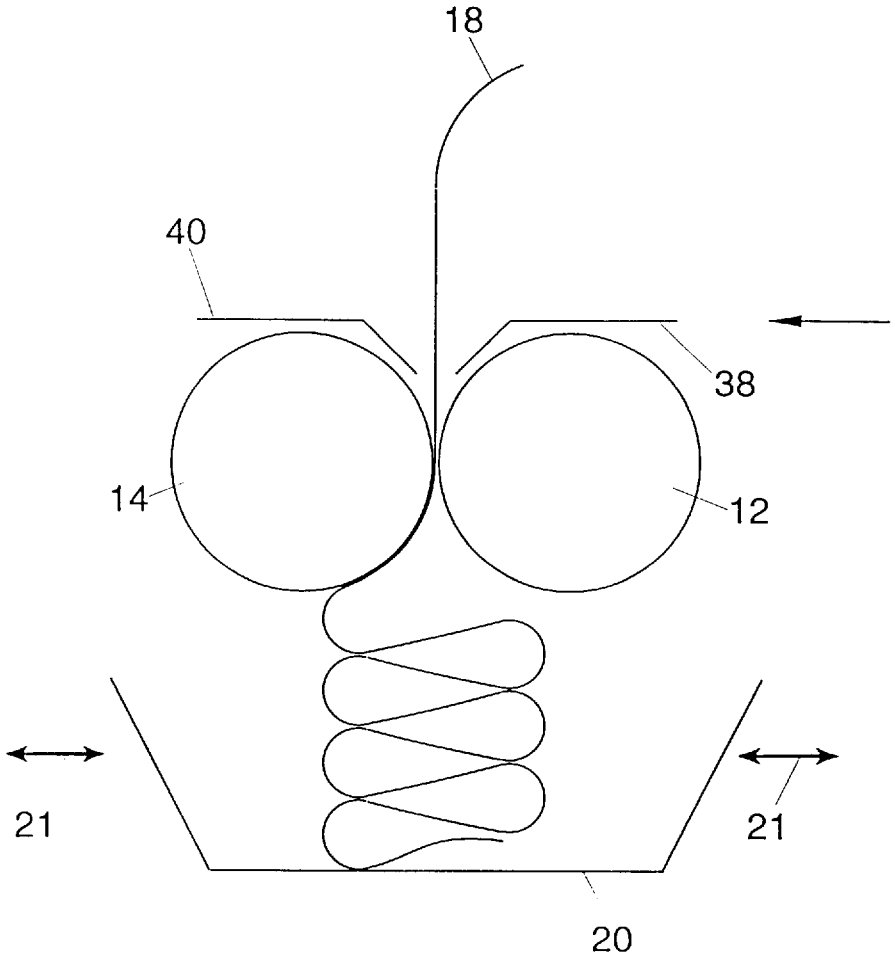
FIG. 1 is a simplified cross-section of the paper disposal and compacting apparatus according to the present invention.

Referring now to the drawings, FIG. 1 illustrates the most simplified form of a paper disposal and compacting apparatus according to the present invention. According to its most simplified form, as shown in FIG. 1, the paper disposal and compacting apparatus 10 includes a first 12 and a second 14 roller, the first 12 and second 14 rollers being situated adjacent and substantially parallel to one another, still, enabling passage of sheets of paper to be disposed 18 between the first 12 and the second 14 rollers. The length of rollers 12 and 14 should fit the width of the paper sheets to be disposed 18. In a preferred embodiment rollers 12 and 14 are laterally movable one relative to the other, thereby enabling to adjust apparatus 10 to sheets of paper of various thicknesses.

As further shown in FIG. 1, apparatus 10 further includes a paper waste container 20. The dimensions of the paper waste container 20 are selected to cause the folding of the sheets of paper to be disposed 18 in a compact accordion like manner. The width of the paper waste container 20 should, therefore, be correlated with papers 18 length. Paper waste containers 20 of variable sizes may be used to dispose sheets of paper of variable lengths.

Alternatively, and preferably, a width adjustable paper waste container may be used as indicated in FIG. 1 by arrows 21.

When operating, the first 12 and the second 14 rollers of apparatus 10 rotate along their axes in an inwardly direction (i.e. when viewed from above) one towards the other. This rotational movement pushes and presses the paper to be disposed 18 into the paper waste container 20 which has dimensions that enforce the sheets of paper to be disposed 18 to fold in a compact accordion like manner. When enough paper 18 is disposed via apparatus 10, it acquires a compact and highly compressed folded form and a compressed package of folded paper, sized as the paper waste container 20 is formed. Detaching the paper waste container 20 from apparatus 10, disposing the compressed paper package and then, reconnecting the paper waste container 20 onto apparatus 10, enables further cycles of paper disposing.

Various means and configurations for rotating the first 12 and the second 14 rollers around their axes may be employed. Some are described hereinbelow.

Figure 2:
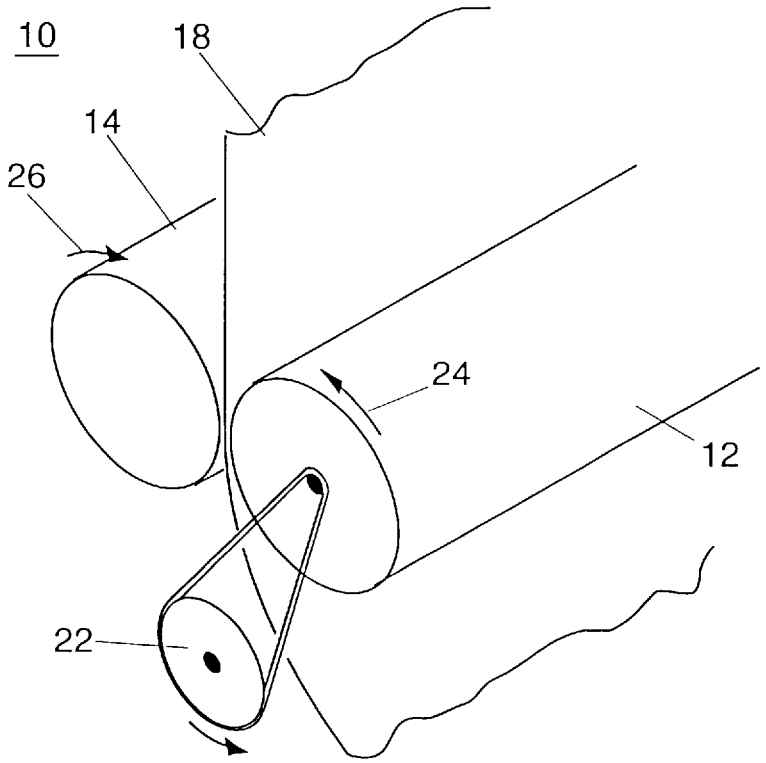
FIG. 2 is a perspective view of a first configuration of the paper disposal and compacting apparatus according to the present invention in which the first roller is connected to a first roller driving device supplying it with a first rotational motive force for rotating it inwardly towards the second roller.

As shown in FIG. 2, in a first configuration, the first roller 12 is connected to a first roller driving device 22, the first roller driving device 22 is supplying the first roller 12 with a first rotational motive force 24 for rotating the first roller 12 inwardly towards the second roller 14. According to the first configuration described hereinabove, sheets of paper to be disposed 18 act as a relay system supplying the second roller 14 with a second rotational motive force 26 for rotating the second roller 14 inwardly towards the first roller 12.

Figure 3:
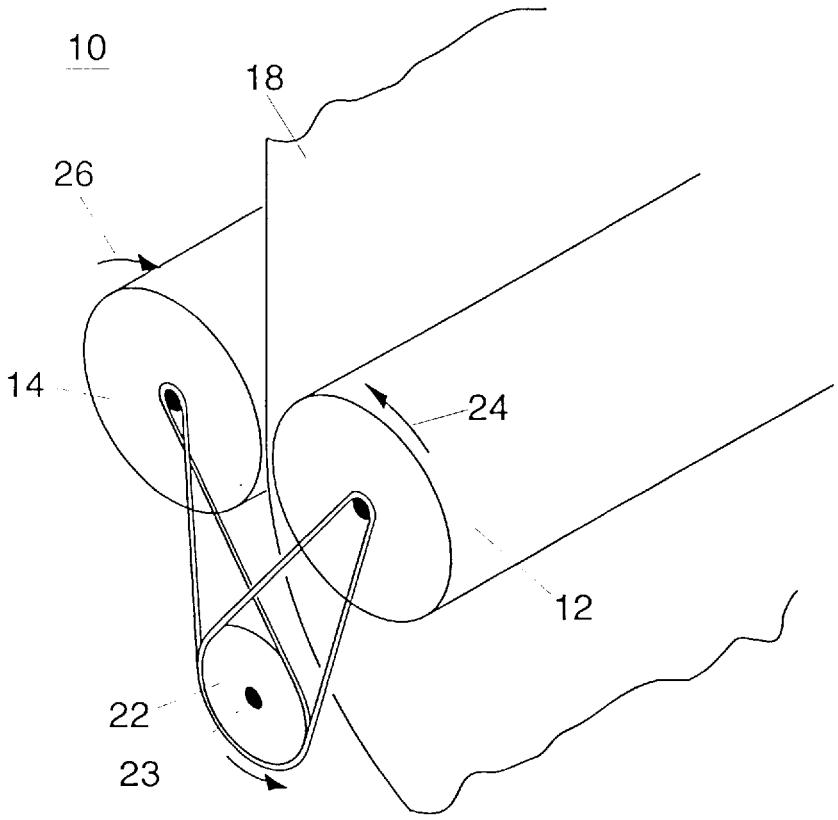
FIG. 3 is a perspective view of a second configuration of the paper disposal and compacting apparatus according to the present invention in which the first roller driving device is further connected to the second roller supplying it with a second rotational motive force for rotating it inwardly towards the first roller.

As shown in FIG. 3, in a second configuration, the first roller driving device 22 is further connected to the second roller 14 and, therefore, itself supplying the second roller 14 with the second rotational motive force 26 for rotating the second roller 14 inwardly towards the first roller 12.

Figure 4:
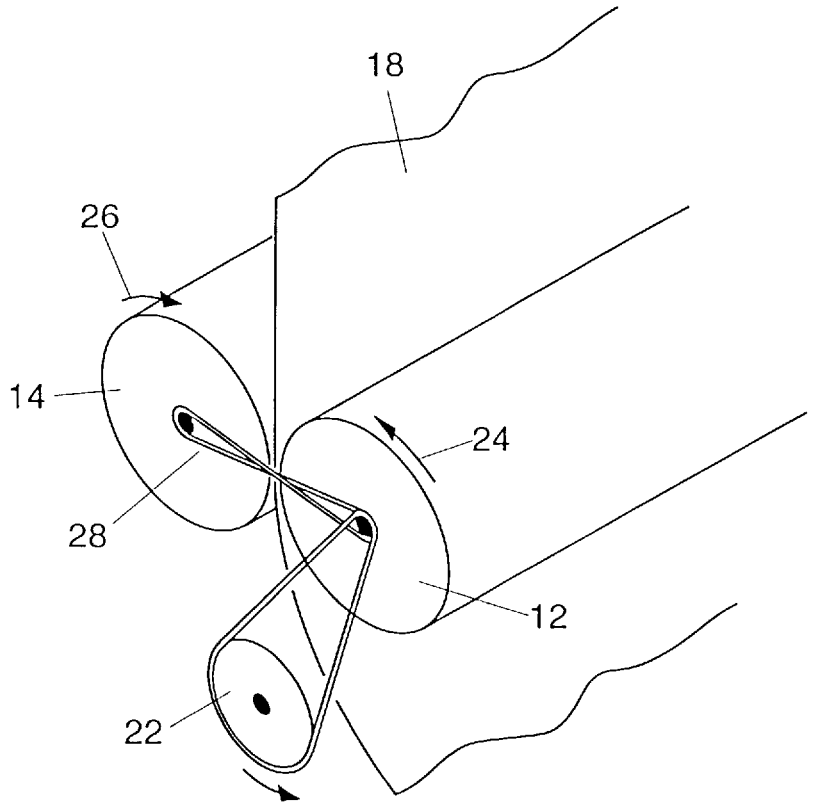
FIG. 4 is a perspective view of a third configuration of the paper disposal and compacting apparatus according to the present invention in which a band based relay mechanism connecting the second roller to the first roller, thereby transmitting a fraction of the first rotational motive force from the first roller onto the second roller.

As shown in FIG. 4, in a third configuration a relay mechanism 28 connecting the second roller 14 to the first roller 12, thereby transmitting a fraction of the first rotational motive force 24 from the first roller 12 onto the second roller 14, thereby supplying the second roller 14 with a second rotational motive force 26 for rotating the second roller 14 inwardly towards the first roller 12.

Figure 5:
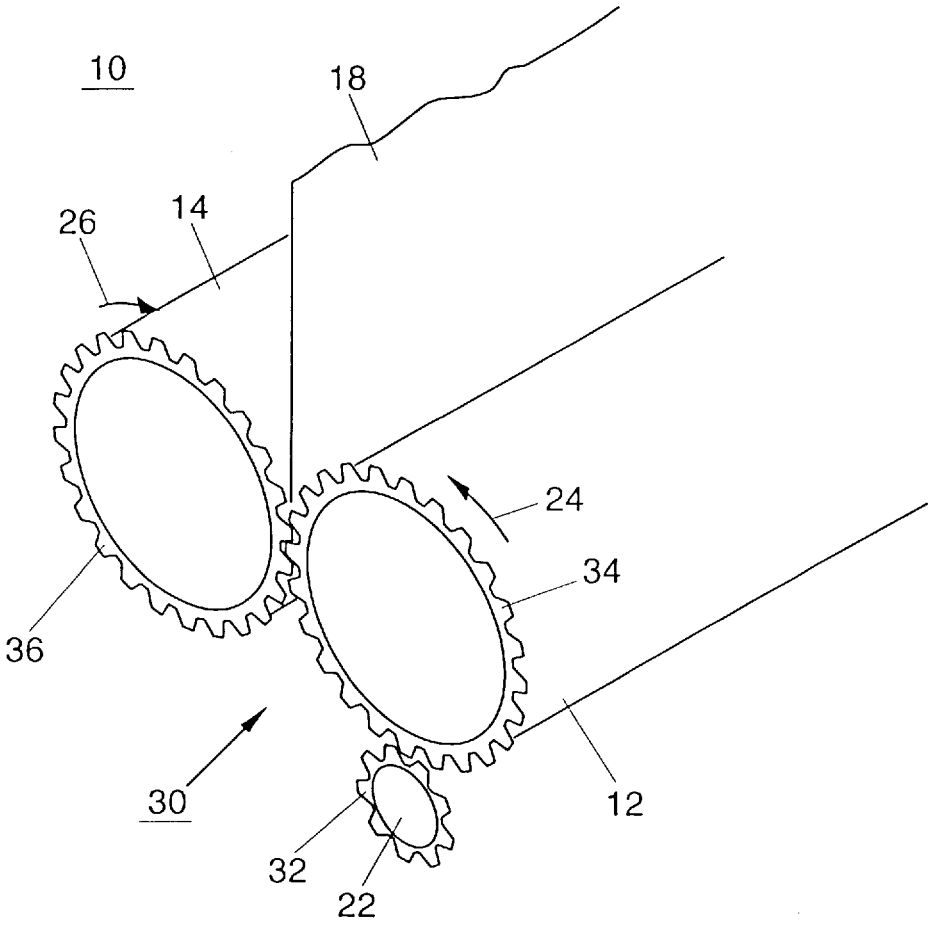
FIG. 5 is a perspective view of another configuration of the paper disposal and compacting apparatus according to the present invention in which a gear relay mechanism is employed to provide the rollers with a motive driving force.

The relay mechanisms thus described in FIGS. 2–4 are band based. These band based relay mechanisms may be substituted by a gear relay mechanism 30, as shown in FIG. 5. In the configuration shown in FIG. 5, which is a substituted for the third configuration described hereinabove and shown in FIG. 4, the first roller driving device 22, the first 12 and the second 14 rollers are equipped with gear wheels 32, 34 and 36, respectively, forming gear relay mechanism 30. The gear relay mechanism 30 is supplying the first roller 12 with a first rotational motive force 24 for rotating the first roller 12 inwardly towards the second roller 14. The first roller 12 is transmitting a fraction of the first rotational motive force 24 via gear wheel 34 onto gear wheel 36 connected to the second roller 14, thereby supplying the second roller 14 with a second rotational motive force 26 for rotating the second roller 14 inwardly towards the first roller 12.

Similarly, simple gear relay mechanisms may replace the band based relay mechanisms described in FIGS. 2 and 3 as well (not shown). Furthermore, a combined relay mechanism involving a gear relay mechanism in part and a band based relay mechanism in part may be employed in various configurations and combinations (not shown).

It is understood to one ordinarily skilled in the art that a second roller driving device connected to the second roller and supplying the second roller with the second rotational motive force for rotating the second roller inwardly towards the first roller may be used, as indicated in FIG. 3 by 23.

It is also understood that various different relay systems or direct transmission of rotational movement may provide the first roller with the first rotational motive force for rotating the first roller inwardly towards the second roller and, at the same time, to provide the second roller with the second rotational motive force for rotating the second roller inwardly towards the first roller.

Nevertheless, according to any of the above-described configurations, it is understood to one ordinarily skilled in the art that the roller driving device(s) may also be operated in the opposite direction. In this case the rollers will rotate in an outwardly direction and away from one another. This reversed mode of the paper disposal and compacting apparatus of the present invention is useful when a bundle of papers which is too thick is stuck between the first and the second rollers, preventing them from rotating according to the above described operative mode. Reverse operation of the apparatus will, in this case, enable to remove the stuck bundle of papers from between the rollers, which papers may be re-disposed by the apparatus in successive parts.

Figure 6:
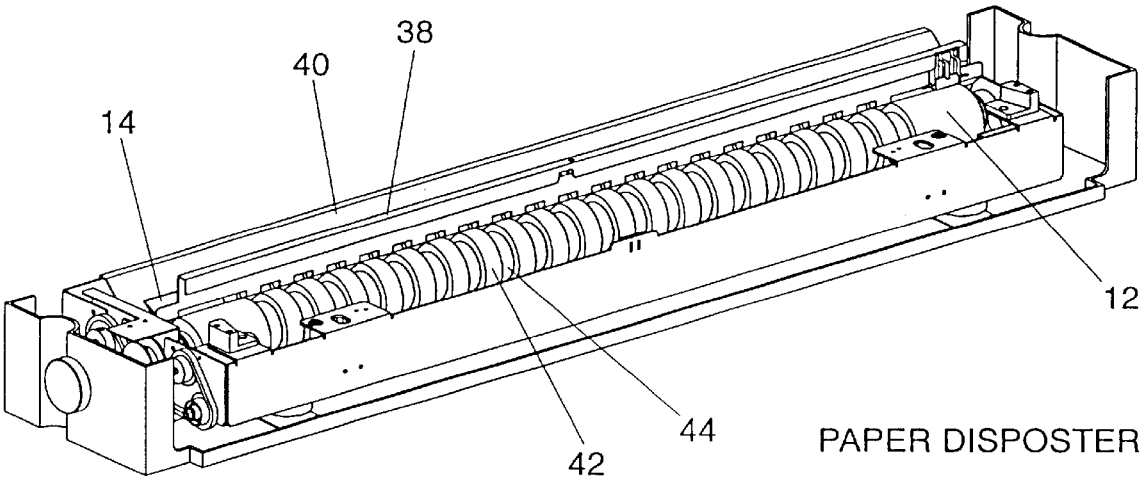
FIG. 6 is a detailed perspective view of the paper disposal and compacting apparatus according to the present invention.

Referring now to FIGS. 1 and 6 and 7, according to the preferred embodiments, apparatus 10 further includes first 38 and second 40 paper guidings, the first paper guiding 38 being deployed above or substantially around the first roller 12 and the second paper guiding 40 being deployed above or substantially around the second roller 14. The first 38 and a second 40 paper guidings serve three main functions. The first main function served by the first 38 and a second 40 paper guidings is directing the sheets of paper to be disposed 18 between the first 12 and the second 14 rollers and to prevent the sheets from rolling out side apparatus 10 between the sides of container 20 and rollers 12 and 14. The second main function served by the first 38 and the second 40 paper guidings is preventing harmful objects from reaching the first 12 and the second 14 rollers of apparatus 10. The third main function served by the first 38 and the second 40 paper guidings is protecting the hands of an operator of apparatus 10, in cases where sheets of paper are not automatically fed into apparatus 10 by, for example, a feeding line.

Figure 7A:
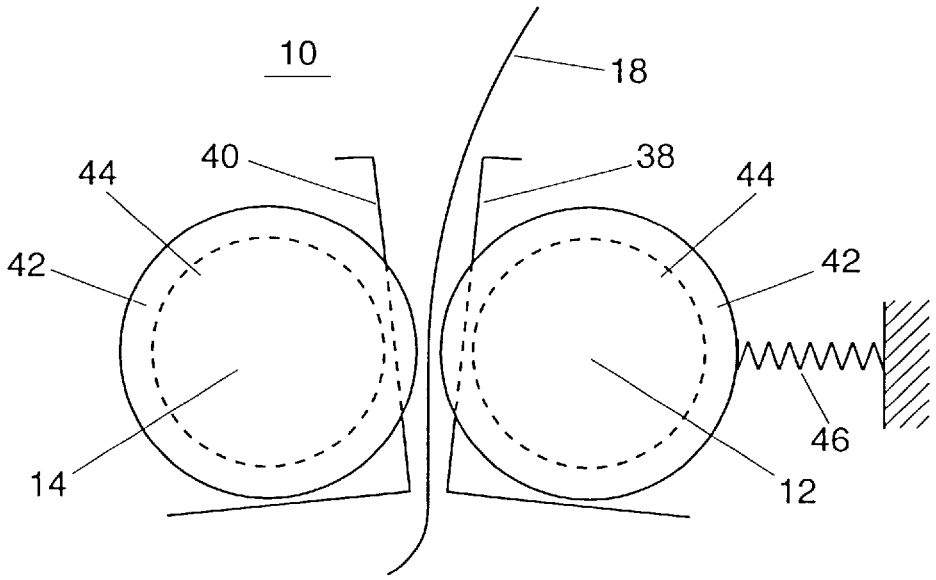
FIGS. 7*a* and 7*b* are simplified cross sections of the paper disposal and compacting apparatus in the configuration detailed in FIG. 6 across a ridge and across a groove, respectively.
Figure 7B:
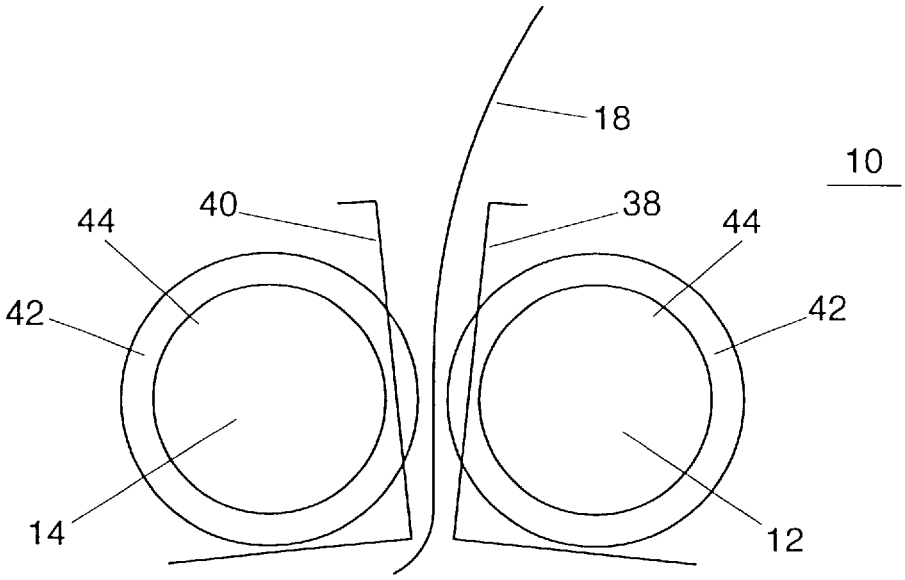

As further shown in FIGS. 6 and 7*a–b,* the first 12 and the second 14 rollers may have alternating ridges 42 and grooves 44 along at least part of their length. This make-up of the first 12 and the second 14 rollers ensures equal progression of the sheets of paper to be disposed 18 into the paper waste container 20 on both sides of apparatus 10. Furthermore, as shown in FIGS. 6 and 7*a–b,* in this case, the first 38 and the second 40 paper guidings may acquire a comb like structure and therefore to intermesh with the ridges and grooves of rollers 12 and 14 as to properly serve their main first functions listed hereinabove.

As shown in FIG. 7*a,* the paper disposal and compacting apparatus 10 of the present invention may further include a bias mechanism 46, pressing rollers 12 and 14 against the sheets of paper to be disposed 18.

The first 12 and the second 14 rollers of the paper disposal and compacting apparatus of the present invention may be made of any solid material, such as, but not limited to, metal, plastic, wood, glass, synthetic polymers, natural polymers and any combinations thereof. Nevertheless, at present, rubber is selected as a preferred material since its elasticity provides apparatus 10 with an intrinsic bias mechanism.

While the invention has been described with respect to a limited number of embodiments, it will be appreciated that many variations, modifications and other applications of the invention may be made.

What is claimed is:

1. A paper disposal and compacting apparatus capable of causing sheets of paper and other substrates to be disposed, to fold in a compact accordion like manner, comprising:

(a) a first roller and a second roller adjacent and parallel to one another to force the sheets to pass between said rollers;

(b) a first roller driving device for rotating said first roller;

(c) a paper waste container for receiving the sheets after passing between said rollers, said container having dimensions selected such that after the sheets pass between said rollers, the sheets are accepted by said container and are caused to fold in the compact accordion like manner; and (d) first and second paper guidings for directing said sheets between said first and second rollers.

2. An apparatus as in claim 1, wherein said first roller driving device is further connected to said second roller to rotate said second roller.

3. An apparatus as in claim 2, wherein at least one of said first and second rollers has alternating ridges and grooves.

4. An apparatus as in claim 2, wherein at least one of said first and second rollers is made of a material selected from the group of materials consisting of rubber, metal, plastic, wood, glass, synthetic polymers, natural polymers and any combination of rubber, metal, plastic, wood, glass, synthetic polymers and natural polymers.

5. An apparatus as in claim 2, wherein said rollers are laterally movable one relative to the other in relation to said sheets thickness.

6. An apparatus as in claim 2, wherein said dimensions of said paper waste container are adjustable in relation to a size of said sheets.

7. An apparatus as in claim 2, further comprising a bias mechanism for pressing said rollers against said sheets.

8. An apparatus as in claim 1, further comprising a relay mechanism, said relay mechanism connecting said second roller to said first roller to rotate said second roller.

9. An apparatus as in claim 8, wherein said relay mechanism is a gear relay mechanism.

10. An apparatus as in claim 8, wherein said relay mechanism is a figure of eight band based relay mechanism.

11. An apparatus as in claim 8, wherein at least one of said first and second rollers has alternating ridges and grooves.

12. An apparatus as in claim 8, wherein at least one of said first and second rollers is made of a material selected from the group of materials consisting of rubber, metal, plastic, wood, glass, synthetic polymers, natural polymers and any combination of rubber, metal, plastic, wood, glass, synthetic polymers and natural polymers.

13. An apparatus as in claim 8, wherein said rollers are laterally movable one relative to the other in relation to said sheets thickness.

14. An apparatus as in claim 8, wherein said dimensions of said paper waste container are adjustable in relation to a size of said sheets.

15. An apparatus as in claim 8, further comprising a bias mechanism for pressing said rollers against said sheets.

16. An apparatus as in claim 1, further comprising a second roller driving device to rotate said second roller.

17. An apparatus as in claim 16, wherein at least one of said first and second rollers has alternating ridges and grooves.

18. An apparatus as in claim 16, wherein at least one of said first and second rollers is made of a material selected from the group of materials consisting of rubber, metal, plastic, wood, glass, synthetic polymers, natural polymers and any combination of rubber, metal, plastic, wood, glass, synthetic polymers and natural polymers.

19. An apparatus as in claim 16, wherein said rollers are laterally movable one relative to the other in relation to said sheets thickness.

20. An apparatus as in claim 16, wherein said dimensions of said paper waste container are adjustable in relation to a size of said sheets.

21. An apparatus as in claim 16, further comprising a bias mechanism for pressing said rollers against said sheets.

22. An apparatus as in claim 1, wherein at least one of said first and second rollers has alternating ridges and grooves.

23. An apparatus as in claim 1, wherein at least one of said first and second rollers is made of a material selected from the group of materials consisting of rubber, metal, plastic, wood, glass, synthetic polymers, natural polymers and any combination of rubber, metal, plastic, wood, glass, synthetic polymers and natural polymers.

24. An apparatus as in claim 1, wherein said rollers are laterally movable one relative to the other in relation to said sheets thickness.

25. An apparatus as in claim 1, wherein said dimensions of said paper waste container are adjustable in relation to a size of said sheets.

26. An apparatus as in claim 1, further comprising a bias mechanism for pressing said rollers against said sheets.

27. A paper disposal and compacting apparatus capable of causing sheets of paper and other substrates to be disposed, to fold in a compact accordion like manner, comprising:

(a) a first roller and a second roller adjacent and parallel to one another to force the sheets to pass between said rollers;

(b) a first roller driving device for rotating said first roller; and (c) a paper waste container for receiving the sheets after passing between said rollers, said container having adjustable dimensions for adjusting said dimensions in relation to a size of said sheets, such that after the sheets pass between said rollers the sheets are accepted by said container and are caused to fold in the compact accordion like manner.

* * * * *